US009255587B2

(12) United States Patent
Kunz et al.

(10) Patent No.: US 9,255,587 B2
(45) Date of Patent: Feb. 9, 2016

(54) HYDRAULIC TWO-WAY VALVE FOR THE LIFTING MECHANISM OF AN AGRICULTURAL VEHICLE

(71) Applicant: Robert Bosch GmbH, Stuttgart (DE)

(72) Inventors: Reiner Kunz, Sachsenheim (DE); Simon Ehmann, Weinstadt (DE); Joerg Mueller, Burgbernheim (DE)

(73) Assignee: Robert Bosch GmbH, Stuttgart (DE)

( * ) Notice: Subject to any disclaimer, the term of this patent is extended or adjusted under 35 U.S.C. 154(b) by 531 days.

(21) Appl. No.: 13/690,960

(22) Filed: Nov. 30, 2012

(65) Prior Publication Data

US 2013/0139915 A1 Jun. 6, 2013

(30) Foreign Application Priority Data

Dec. 3, 2011 (DE) ..... 10 2011 120 302

(51) Int. Cl.
*F15B 13/04* (2006.01)

(52) U.S. Cl.
CPC ..... *F15B 13/04* (2013.01); *F15B 2211/3122* (2013.01); *F15B 2211/3127* (2013.01); *F15B 2211/327* (2013.01); *Y10T 137/85978* (2015.04)

(58) Field of Classification Search
CPC ..... F15B 2013/0413; F15B 2211/327; F15B 2211/3127; F15B 13/0416; F15B 13/0442; F15B 2211/20546; F15B 2211/3144; Y10T 137/85978
USPC ..... 60/435, 443; 91/481
See application file for complete search history.

(56) References Cited

U.S. PATENT DOCUMENTS 4,565,219 A * 1/1986 Kunogi ..... 137/625.65
5,058,383 A * 10/1991 Tsunemi et al. ..... 60/493
6,971,453 B2 12/2005 Nordhoff

FOREIGN PATENT DOCUMENTS

DE 29 05 332 A1 8/1980
DE 38 36 453 A1 7/1989
DE 40 36 564 A1 5/1992
EP 0 536 124 B1 1/1996
EP 1 108 895 A1 6/2001
WO WO 2012104485 A1 * 8/2012 ..... F15B 21/00

OTHER PUBLICATIONS

German Search Report corresponding to German Application No. 10 2011 120 302.1, mailed Jun. 6, 2012 (5 pages).

* cited by examiner

*Primary Examiner* — Thomas E Lazo
(74) *Attorney, Agent, or Firm* — Maginot, Moore & Beck LLP

(57) ABSTRACT

A hydraulic two-way valve includes a pump connection, a tank connection, and first and second working connections. The working connections are connectable to a hydraulic cylinder of an agricultural vehicle lifting mechanism. The pump connection is connectable to a hydraulic pump. In a first position, the pump connection, tank connection, and working connections are shut off. In a second position, the pump connection is connected to the first working connection and the tank connection to the second working connection. In a third position, the pump connection is connected to the second working connection and the tank connection to the first working connection. In a fourth position, the working connections are connected to the tank connection and the pump connection is shut off. In a fifth position, the tank connection is connected to the second working connection and the pump connection and first working connection are shut off.

10 Claims, 2 Drawing Sheets

HYDRAULIC TWO-WAY VALVE FOR THE LIFTING MECHANISM OF AN AGRICULTURAL VEHICLE

This application claims priority under 35 U.S.C. §119 to patent application no. DE. 10 2011 120 302.1, filed on Dec. 3, 2011 in Germany, the disclosure of which is incorporated herein by reference in its entirety.

BACKGROUND

The disclosure relates to a hydraulic two-way valve according to the description below.

The hydraulic lifting mechanism of an agricultural vehicle is disclosed in U.S. Pat. No. 6,971,453 B2, with reference to FIGS. 1 and 2 therein. The lifting mechanism comprises two hydraulic cylinders 12; 14 for lifting and lowering the lifting mechanism. Said hydraulic cylinders are connected to the first and to the second working connection of a hydraulic two-way valve 24. The two-way valve, moreover, has a pump connection which is connected to a hydraulic pump which is able to deliver hydraulic fluid from a storage tank 18 to the hydraulic cylinders. The two-way valve also has a tank connection which is connected to the storage tank.

The hydraulic two-way valve is configured as a proportional valve and has four switching positions. In the first switching position, the pump connection, the tank connection and the first and the second working connection are shut off, so that the position of the lifting mechanism is not able to be altered.

In the second switching position, the pump connection is connected to the first working connection and the tank connection is connected to the second working connection, so that the lifting mechanism is lowered, wherein the tool connected thereto is able to be pressed against the ground.

In the third switching position, the pump connection is connected to the second working connection and the tank connection is connected to the first working connection, so that the lifting mechanism may be lifted.

Furthermore, a fourth switching position is provided which is configured as a release position, i.e. the first and the second working connections are connected to the tank connection, wherein the pump connection is shut off. In this switching position, the lifting mechanism may be freely lifted and lowered by forces acting from the outside. Said switching position is used when a tool is attached to the lifting mechanism, said tool being supported on the ground when the agricultural vehicle moves, wherein the tool is intended to follow said vehicle. The tool may, for example, be a mowing device.

Moreover, a separate switching valve 42 is provided in U.S. Pat. No. 6,971,453 B2, with which a further switching state is implemented in which the first working connection is connected to the storage tank. Said switching valve is shut off in the already-described switching positions of the two-way valve. In the aforementioned further switching state it is open, wherein the two-way valve is located in the second switching position. The hydraulic pump thus delivers fluid at no load into the tank, so that no pressure builds up on the hydraulic cylinder. In this switching state, the lifting mechanism is only able to be lowered by the intrinsic weight of the attached tool. Said switching state is, for example, used in order to lower the lifting mechanism before it is moved into the release position already discussed.

SUMMARY

The object of the disclosure is to provide a hydraulic two-way valve in which, for implementing the aforementioned further switching state, the separate switching valve may be dispensed with.

According to the description below, this object is achieved by a fifth switching position being provided in which the tank connection is connected to the second working connection, wherein the pump connection and the first working connection are shut off. As a replacement for the separate switching valve, the two-way valve is provided with a further fifth switching position. In this fifth switching position, the pump connection is shut off. In contrast to the above-described solution, the pump delivery flow is not diverted via the two-way valve to the storage tank. The first working connection is also shut off. By means of said embodiment of the two-way valve, an additional switching valve may be dispensed with.

Advantageous developments and improvements of the disclosure are specified in the description below.

The hydraulic two-way valve may have a valve slide which is movable in a linear manner, and during the movement thereof the switching positions are passed through in the sequence:

third switching position;
first switching position;
fifth switching position;
second switching position; and
fourth switching position. By means of this embodiment, the hydraulic two-way valve may be produced particularly easily. In contrast to the known two-way valve, only the position of a single fine control notch has to be altered in order to implement the fifth switching position according to the disclosure. This is described in more detail with reference to FIG. 3.

A load pressure connection to the hydraulic two-way valve may be provided, said load pressure connection being able to be connected to the pressure regulator of the hydraulic pump, wherein the load pressure connection in the second and the third switching positions is connected to the pump connection, wherein it is connected to the tank connection in the first, the fourth and the fifth switching positions. Hydraulic lifting mechanism controls which operate according to the load sensing principle are known from the prior art. In this case, the load pressure acting on the hydraulic cylinder is transmitted back to the pressure regulator of the pump in order to regulate the pump pressure. As a result, an energy-saving operation of the hydraulic pump is possible. By means of the proposed solution, the use of the load sensing principle is also possible in the fifth switching state according to the disclosure.

The two-way valve may be configured as a proportional valve, in which all fluid connections continuously open and close. As a result, the lifting mechanism may be moved accurately, i.e. slow and rapid movement speeds may be finely tuned depending on the wishes of the operator.

Between the second and the fourth switching positions the valve slide may pass through a first transition region, in which the pump connection is connected to the first working connection, wherein the fluid connection from the first working connection to the tank connection is shut off. The transition between the second and the fourth switching positions requires several alterations with regard to the arrangement of the connections of the two-way valve. By introducing the proposed transition region which, during operation, is always only briefly passed through and not substantially used for the movement control, said alterations to the arrangement may be implemented particularly easily.

Between the first transition region and the fourth switching position the valve slide may pass through a second transition region, in which the fluid connection from the tank connection to the first working connection continuously opens. By this measure, a simple implementation of the two-way valve is also possible.

BRIEF DESCRIPTION OF THE DRAWINGS

The disclosure is described in more detail hereinafter with reference to the accompanying drawings, in which.

DETAILED DESCRIPTION

Figure 1:
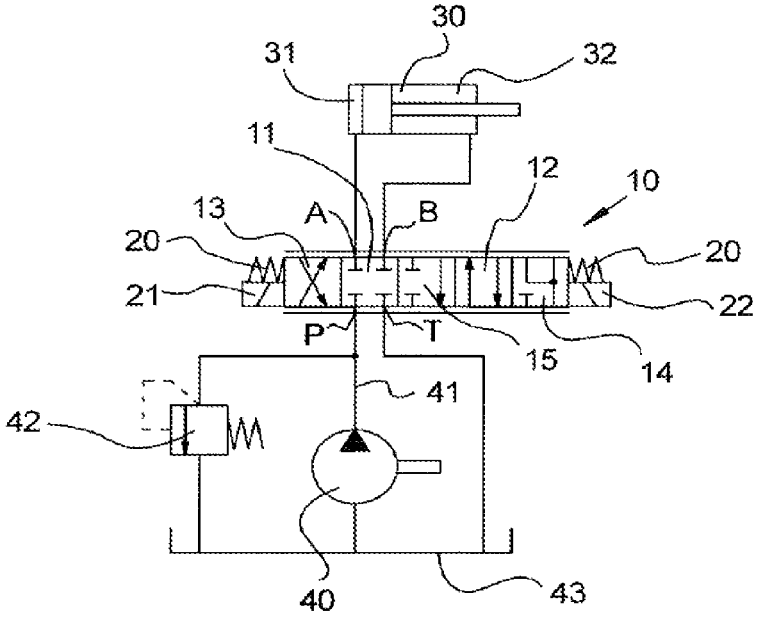
FIG. 1 shows a circuit arrangement with a hydraulic two-way valve according to a first embodiment.

FIG. 1 shows a circuit arrangement with a hydraulic two-way valve 10 according to a first embodiment. The hydraulic cylinder 30 is a component of a lifting mechanism (not shown) of an agricultural vehicle. The lifting mechanism is lowered by being subjected to pressure by the cylinder chamber 31 on the piston base side. The cylinder chamber 31 on the piston base side is in this case attached to the first working connection A of the two-way valve 10. The lifting mechanism is raised by being subjected to pressure by the opposing cylinder chamber 32 on the annular surface side. The cylinder chamber 32 on the annular surface side in this case is attached to the second working connection B of the two-way valve 10.

The hydraulic cylinder 30 is driven by a hydraulic pump 40 which draws hydraulic fluid out of the storage tank 43 and under pressure delivers hydraulic fluid to the hydraulic cylinder 30. The hydraulic pump 40 is attached to the pump connection P of the two-way valve 10. The corresponding pump line 41 is attached to a pressure limiting valve 42 which limits the pump pressure upwards, in particular when the pump connection P of the two-way valve 10 is shut off. The corresponding delivery flow is diverted into the storage tank 43. The tank connection T of the two-way valve 10 is also connected to the storage tank 43.

The two-way valve 10 is retained in the first switching position 11 via the two restoring springs 20 acting in the opposing direction. In the first switching position 11: the pump connection P, the tank connection T and the first and second working connections A; B are shut off. The lifting mechanism is thus held immovably in its current position, wherein the hydraulic pump 40 delivers fluid into the storage tank 43 via the pressure reducing valve 42. To save energy, a hydraulic pump may be provided with an adjustable displacement volume.

For the purpose of adjusting the third switching state 13, the valve slide is moved to the right by the first electromagnetic actuation 21, so that the pump connection P is connected to the second working connection B and the first working connection A is connected to the tank connection T. As a result, the lifting mechanism is raised.

By means of the second electromagnetic actuation 22, the valve slide is displaced to the left, wherein it reaches the fifth 15, the second 12 and the fourth switching positions 14 in succession.

In the fifth switching position 15 according to the disclosure, the pump connection P and the first working connection A are shut off, wherein the second working connection B is connected to the tank connection T. The hydraulic fluid in the cylinder chamber 32 on the annular surface side is subjected to pressure by the weight of the tool attached to the lifting mechanism, wherein it is able to flow out in a controlled manner into the storage tank 43, via the opening cross-sectional area set in the two-way valve 10. The lifting mechanism is thus lowered of its own accord due to its intrinsic weight.

If the valve slide is now moved further into the second switching position 12, the pump connection P is connected to the first working connection A, so that the lifting mechanism is able to be forced downwards with the tool by hydraulic force in addition to the intrinsic weight.

In the fourth switching position 14, the first and the second working connections A; B are connected to the tank connection T, wherein the pump connection P is shut off. In this switching position, the lifting mechanism is able to move freely due to the forces acting from outside.

Figure 2:
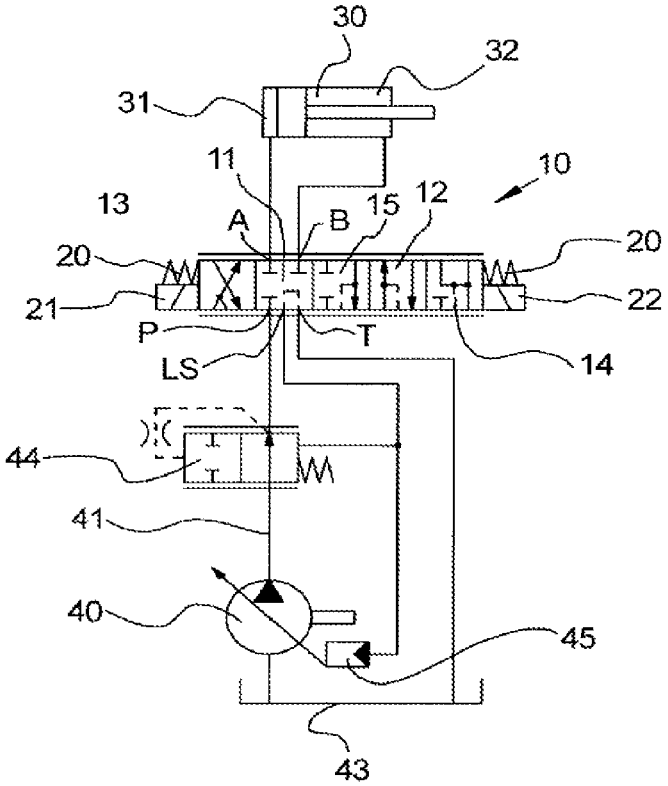
FIG. 2 shows a circuit arrangement with a hydraulic two-way valve according to a second embodiment.

FIG. 2 shows a switching arrangement with a hydraulic two-way valve 10 according to a second embodiment. In contrast to the first embodiment, in the second embodiment a load pressure connection LS is provided on the two-way valve 10, which is connected to a pressure regulator 44, a hydraulic adjusting device 45 and a hydraulic pump 40 with an adjustable displacement volume. In the second and the third switching positions 12; 13 in which the hydraulic cylinder 30 is to be moved by the flow of fluid from the hydraulic pump 40, the pump connection P of the two-way valve is connected to the load pressure connection LS. The displacement volume of the hydraulic pump 40 is thus regulated according to the volumetric flow required on the hydraulic cylinder 30, so that an excess flow of fluid does not have to be diverted into the storage tank 43.

In the remaining switching positions, one 11, four 14 and five 15, in which the hydraulic pump 40 does not drive the lifting mechanism, the load pressure connection LS is connected to the tank connection T, so that the displacement volume of the hydraulic pump 40 is substantially set to zero. Thus the hydraulic pump 40 does not substantially deliver any hydraulic fluid and accordingly requires very little drive power.

The second embodiment of the disclosure corresponds in other respects to the first embodiment so that in this regard reference may be made to the embodiments of FIG. 1.

Figure 3:
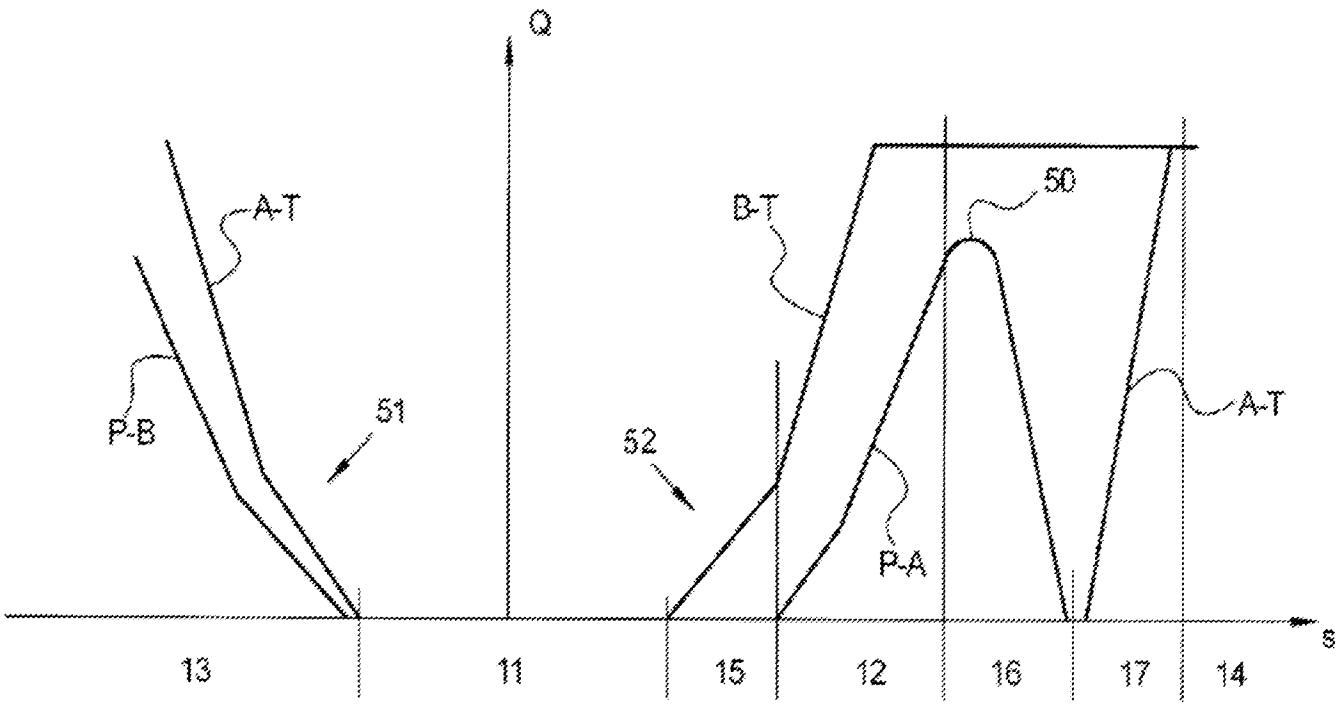
FIG. 3 shows a diagram in which the opening cross-sectional area of the different connecting paths of the two-way valve is plotted over the movement path of the valve slide.

FIG. 3 shows a diagram in which the opening cross-sectional area Q of the different connecting paths of the two-way valve is plotted above the movement path S of the valve slide. The fluid connections to the load pressure connection according to the second embodiment of the disclosure are not shown, due to the flow of only very small volumetric flows in this case, so that the configuration of the corresponding switching transitions is less critical.

The movement path S of the valve slide is plotted on the horizontal. The opening cross-sectional area Q of the corresponding fluid connection is plotted on the vertical. The coordinate origin corresponds to the position of the valve slide which is set by the two restoring springs 20, as shown in FIGS. 1 and 2.

The first switching position 11 is arranged in the region of the coordinate origin. In the first switching position 11 all fluid connections are substantially completely closed. However, volumetric flows caused by unavoidable leakages do occur.

If the valve slide is moved into the third switching position 13, the fluid connection A-T from the first working connection to the tank connection opens slightly earlier than the fluid connection P-B from the pump connection to the second working connection. Moreover, the opening cross-sectional area of the fluid connection A-T is always larger than the opening cross-sectional area of the fluid connection P-B, so that the hydraulic fluid flowing back into the storage tank is subjected to a lower counterpressure. The graphs of the two connections P-B and A-T show a fine control region 51 with a smaller gradient, which serves for the finely-tuned movement of the lifting mechanism. The remaining region with the larger gradient has been introduced in order to be able to set greater volumetric flows by small alterations to the slide path S. As a result, the total slide path and thus the overall size of the two-way valve may be kept small.

If the valve slide is moved from the first switching position 11 into the fifth switching position 15, initially the fluid connection B-T opens from the second working connection to the tank connection. This point marks the start of the fifth switching position 15. Also in this case, a fine control region 52 with a small gradient is provided. If the end of the fine control region 52 of the fluid connection B-T is reached, the fluid connection P-A from the pump connection to the first working connection also opens. This position marks the start of the second switching position 12.

If the valve slide is now moved further in the direction of the end position, the fluid connection B-T reaches its maximum opening cross-sectional area which remains constantly open until the aforementioned end position. Shortly after the fluid connection B-T has reached its maximum opening cross-sectional area, the fluid connection P-A also reaches its maximum opening cross-sectional area 50, wherein said opening cross-sectional area again reduces to zero with the further movement of the valve slide. In this case, the maximum opening cross-sectional area 50 of the fluid connection P-A is smaller than the maximum opening cross-sectional area of the fluid connection B-T, so that even in this case the hydraulic fluid flowing back to the storage tank is subjected to a lower counterpressure.

At the latest, the maximum 50 of the opening cross-sectional area of the fluid connection P-A marks the end of the second switching position 12. Preferably, the second switching position 12, however, ends slightly earlier. The first transition region 16 starting here reaches the point at which the fluid connection P-A is completely closed. A second transition region 17 is adjacent to said first transition region, in which the fluid connection A-T from the first working connection to the tank connection opens rapidly but continuously as far as a maximum opening cross-sectional area. The maximum opening cross-sectional areas of the fluid connections A-T and B-T are of the same size. The fourth switching position 14 starts at this point in which the opening cross-sectional areas of the fluid connections A-T and B-T remain constant.

It is noteworthy that the first and the second transition region 16; 17 are only briefly passed through during the operation of the two-way valve.

What is claimed is:

1. A hydraulic two-way valve comprising:

a pump connection configured to be connected to a hydraulic pump;

a tank connection;

a first working connection and a second working connection configured to be connected to a hydraulic cylinder of a lifting mechanism of an agricultural vehicle; wherein:

in a first switching position, the pump connection, the tank connection, the first working connection and the second working connection are shut off;

in a second switching position, the pump connection is connected to the first working connection and the tank connection is connected to the second working connection;

in a third switching position, the pump connection is connected to the second working connection and the tank connection is connected to the first working connection;

in a fourth switching position, the first working connection and the second working connection are connected to the tank connection, and the pump connection is shut off; and in a fifth switching position the tank connection is connected to the second working connection, and the pump connection and the first working connection are shut off; and a valve slide configured to move linearly to pass through the switching positions in a sequence:

third switching position;

first switching position;

fifth switching position;

second switching position; and fourth switching position.

2. The hydraulic two-way valve according to claim 1, further comprising:

a load pressure connection configured to be connected to a pressure regulator of the hydraulic pump, wherein the load pressure connection is connected to the pump connection in the second and the third switching positions and the load pressure connection is connected to the tank connection in the first, the fourth and the fifth switching positions.

3. The hydraulic two-way valve according to claim 2, wherein the two-way valve is configured as a proportional valve, in which all fluid connections continuously open and close.

4. The hydraulic two-way valve according to claim 3, wherein between the second and the fourth switching positions the valve slide passes through a first transition region, in which the pump connection is connected to the first working connection and a fluid connection between the first working connection and the tank connection is shut off.

5. The hydraulic two-way valve according to claim 4, wherein between the first transition region and the fourth switching position the valve slide passes through a second transition region, in which a fluid connection between the tank connection and the first working connection continuously opens.

6. A valve slide for a hydraulic valve having a pump port, tank port, and first and second working ports, the valve slide comprising:

a first region that defines:

a first connection configured to connect the pump port and the second working port; and a second connection configured to connect the first working port and the tank port;

a second region that is immediately adjacent to the first region, and that is configured to close off each of the pump port, tank port, and first and second working ports;

a third region that is immediately adjacent to the second region, and that defines a third connection configured to connect the second working port and the tank port;

a fourth region that is immediately adjacent to the third region, and that defines a fourth connection configured to connect the pump port and the first working port, wherein the third connection extends into the fourth region;

a fifth region that is immediately adjacent to the fourth region, wherein the third connection and fourth connection extends into the fifth region; the fifth region defining:

a first transition that closes off the fourth connection; and a second transition that extends from the first transition, and opens a fifth connection configured to connect the first working port and the tank port; and a sixth region that is immediately adjacent to the fifth region, wherein the third connection and fifth connection extend into the sixth region;

wherein the valve slide is configured to linearly slide within the valve so that the regions of the valve slide successively engage the pump port, tank port, and first and second working ports.

7. The valve slide according to claim 6, wherein the first region and the fourth region of the valve slider each further defines a respective connection between a load pressure port of the hydraulic valve and the pump port; and the second region, third region, and sixth region of the valve slider each further define a respective connection between the load pressure port and the tank port.

8. A system comprising:

a hydraulic pump;

a tank;

a hydraulic cylinder; and a hydraulic valve that defines (i) a pump port connected to the hydraulic pump, (ii) a tank port connected to the tank, (iii) a first working port configured to be connected to the hydraulic cylinder, and (iv) a second working port configured to be connected to the hydraulic cylinder, and that includes a valve slide that includes:

a first region that defines:

a first connection configured to connect the pump port and the second working port; and a second connection configured to connect the first working port and the tank port;

a second region that is immediately adjacent to the first region, and that is configured to close off each of the pump port, tank port, and first and second working ports;

a third region that is immediately adjacent to the second region, and that defines a third connection configured to connect the second working port and the tank port;

a fourth region that is immediately adjacent to the third region, and that defines a fourth connection configured to connect the pump port and the first working port, wherein the third connection extends into the fourth region;

a fifth region that is immediately adjacent to the fourth region, wherein the third connection and fourth connection extends into the fifth region; the fifth region defining:

a first transition that closes off the fourth connection; and a second transition that extends from the first transition, and opens a fifth connection configured to connect the first working port and the tank port; and a sixth region that is immediately adjacent to the fifth region, wherein the third connection and fifth connection extend into the sixth region;

wherein the valve slide is configured to linearly slide within the hydraulic valve so that the regions of the valve slide successively engage the pump port, tank port, and first and second working ports.

9. The system according to claim 8, wherein:

the hydraulic pump further includes a pressure regulator;

the hydraulic valve further defines a load pressure port that is configured to be connected to the pressure regulator of the hydraulic pump;

the first region and the fourth region of the valve slider each further defines a respective connection between the load pressure port and the pump port; and the second region, third region, and sixth region of the valve slider each further define a respective connection between the load pressure port and the tank port.

10. The system according to claim 8, wherein the hydraulic valve is configured as a proportional valve, the valve slide being configured to proportionally open and close the connections defined by the regions of the valve slide in a continuous fashion.

* * * * *